US006843215B2

(12) United States Patent
Hiratsuka et al.

(10) Patent No.: US 6,843,215 B2
(45) Date of Patent: Jan. 18, 2005

(54) SLIDING MECHANISM AND VARIABLE VALVE TIMING MECHANISM FOR INTERNAL COMBUSTION ENGINE

(75) Inventors: Ichiro Hiratsuka, Kariya (JP); Shigeru Nakajima, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/173,167

(22) Filed: Jun. 18, 2002

(65) Prior Publication Data

US 2003/0019449 A1 Jan. 30, 2003

(30) Foreign Application Priority Data

Jun. 18, 2001 (JP) ..... 2001-183834

(51) Int. Cl.[7] ..... F01L 1/34

(52) U.S. Cl. ..... 123/90.17; 123/90.15; 464/160

(58) Field of Search ..... 123/90.15, 90.17, 123/90.27, 90.31; 464/1, 2, 160; 428/654; 420/548; 384/902, 913

(56) References Cited

U.S. PATENT DOCUMENTS

| | | | | | |
|---|---|---|---|---|---|
| 4,309,064 | A | * | 1/1982 | Fukuoka et al. | 384/278 |
| 4,551,395 | A | * | 11/1985 | Lloyd | 428/677 |
| 4,789,607 | A | * | 12/1988 | Fujita et al. | 428/653 |
| 4,972,764 | A | * | 11/1990 | Ohya et al. | 92/170.1 |
| 5,185,216 | A | * | 2/1993 | Tanaka et al. | 428/614 |
| 5,368,629 | A | * | 11/1994 | Kondo et al. | 75/249 |
| 5,415,709 | A | * | 5/1995 | Kita | 148/437 |
| 5,464,463 | A | * | 11/1995 | Miura et al. | 75/244 |
| 5,536,587 | A | * | 7/1996 | Whitney, Jr. | 428/653 |
| 5,556,075 | A | | 9/1996 | Weber | |
| 5,755,898 | A | | 5/1998 | Yamamoto et al. | |
| 5,836,278 | A | * | 11/1998 | Scheidt | 123/90.17 |
| 5,947,067 | A | * | 9/1999 | Kawaharaguchi et al. | 123/90.17 |
| 5,993,576 | A | | 11/1999 | Ichinose et al. | |
| 6,267,829 | B1 | * | 7/2001 | Backerud et al. | 148/415 |
| 6,269,785 | B1 | * | 8/2001 | Adachi | 123/90.17 |
| 6,276,322 | B1 | * | 8/2001 | Sekiya et al. | 123/90.17 |
| 6,391,476 | B2 | * | 5/2002 | Wittebrood et al. | 428/654 |

FOREIGN PATENT DOCUMENTS

| | | |
|---|---|---|
| DE | 19324 | 7/1960 |
| DE | 692 09 588 | 11/1996 |
| DE | 693 07 574 | 8/1997 |
| EP | 0 529 542 | 3/1993 |
| EP | 0 533 950 | 3/1993 |
| EP | 0 566 098 | 10/1993 |
| JP | 63-128145 | 5/1988 |
| JP | 1-156446 | 6/1989 |
| JP | 5-179383 | 7/1993 |
| JP | 11-159311 | 6/1999 |

* cited by examiner

*Primary Examiner*—Thomas Denion
*Assistant Examiner*—Ching Chang
(74) *Attorney, Agent, or Firm*—Oblon, Spivak, McClelland, Maier & Neustadt, P.C.

(57) ABSTRACT

A sliding mechanism includes a first sliding member made of an aluminum alloy material, the aluminum alloy material being supplemented with at least an element selected from Sb ranging from 0.05 to 0.20 weight %, Na ranging from 0.001 to 0.01 weight %, Sr ranging from 0.001 to 0.05 weight %, and Ca ranging from 0.0005 to 0.01 weight %; and a second sliding member arranged so as to be brought into sliding engagement with the first sliding member. The second sliding member is made of a material which is obtained by caking a rapidly solidified aluminum powder containing therein at least an Si element and a Fe element. Preferably, the Si element has an average particle diameter of 3 μm or less.

8 Claims, 8 Drawing Sheets

SLIDING MECHANISM AND VARIABLE VALVE TIMING MECHANISM FOR INTERNAL COMBUSTION ENGINE

The present application is based on and claims priority under 35 U.S.C § 119 with respect to Japanese Patent Application No.2001-1883834 on Jun. 18, 2001 ($13^{th}$ Year of Heisei), the entire content of which is incorporated herein by reference.

BACKGROUND OF THE INVENTION

1. Field of the Invention

The present invention is generally directed to a sliding mechanism and a variable valve timing mechanism employing such a sliding mechanism.

2. Background Art

Japanese Patent Laid open Print No. Hei 11 (1999) 159311 discloses a variable valve timing mechanism or variable valve timing control apparatus. This variable valve timing mechanism is provided in an internal combustion engine in order to change the valve timing of intake valves or exhaust valves, to thereby change the operation timing of the intake valves or the exhaust valves in accordance with engine conditions.

In a variable valve timing mechanism of such a type, there are provided a plurality of sliding mechanisms, each of which is made up of a pair of sliding members. In the above-mentioned publication, one of the sliding members is a vane while the other is a housing. The vane and the housing are made of aluminum and Fe-family sintered material, respectively. Due to the fact that a lubrication oil provided between the vane and the housing is reserved or stored in exposed parts of the Fe-family sintered material housing, the sliding movement between the vane and the housing is made smooth and in good order. However, employing Fe-family sintered material for forming the housing makes the variable valve timing mechanism heavier, which is undesirable in a vehicle.

Thus, a need exists to provide a device which is free from the aforementioned drawbacks.

SUMMARY OF THE INVENTION

Accordingly, in order to meet the above need to overcome the aforementioned drawbacks or problems, a first aspect of the present invention provides a sliding mechanism which comprises a first sliding member made of an aluminum alloy material, the aluminum alloy material being supplemented with at least an element selected from Sb ranging from 0.05 to 0.20 weight %, Na ranging from 0.001 to 0.01 weight %, Sr ranging from 0.001 to 0.05 weight %, and Ca ranging from 0.0005 to 0.01 weight %; and a second sliding member arranged so as to oppose the first sliding member, the second sliding member being made of a material which is obtained by caking a rapidly solidified aluminum powder containing therein at least an Si element and a Fe element.

A second aspect of the present invention provides a sliding mechanism according to the first aspect in which the Si element has an average particle diameter of 3 $\mu$m or less.

A third aspect of the present invention is to provide a sliding mechanism which comprises a first sliding member made of an aluminum alloy material, the aluminum alloy material being supplemented with at least an element selected from Sb ranging from 0.05 to 0.20 weight %, Na ranging from 0.001 to 0.01 weight %, Sr ranging from 0.001 to 0.05 weight %, and Ca ranging from 0.0005 to 0.01 weight %; and a second sliding member arranged so as to oppose the first sliding member, the second sliding member being made of a material which is obtained by caking a rapidly solidified aluminum powder containing therein at least an Si element ranging from 16 to 18 weight % and an Fe element ranging from 2 to 6 weight %.

A fourth aspect of the present invention is to provide a sliding mechanism according to the third aspect wherein the Si element has an average particle diameter of 3 $\mu$m or less.

A fifth aspect of the present invention is to provide a variable valve timing mechanism for controlling one of intake and exhaust valves which comprises a cam shaft having a distal end portion, the cam shaft being rotatably mounted in the internal combustion engine cylinder head, an inner rotor fixedly mounted on the distal end portion of the cam shaft, an outer rotor mounted on the inner rotor so as to be rotatable within an angular range and constituting a rotation transmitting mechanism, a vane associated with the inner rotor in one of integration and assembled modes, and a lock pin assembled to the outer rotor, the outer rotor being made of an aluminum alloy material, the aluminum alloy material being supplemented with at least an element selected from Sb ranging from 0.05 to 0.20 weight %, Na ranging from 0.001 to 0.01 weight %, Sr ranging from 0.001 to 0.05 weight %, and Ca ranging from 0.0005 to 0.01 weight %, one of the inner rotor and the vane being made of a material which is obtained by caking a rapidly solidified aluminum powder containing therein at least an Si element and an Fe element.

A sixth aspect of the present invention is to provide a variable valve timing mechanism according to the fifth aspect, wherein the Si element has an average particle diameter of 3 $\mu$m or less.

A seventh aspect of the present invention is to provide a variable valve timing mechanism for controlling one of intake and exhaust valves which comprises a cam shaft having a distal end portion, the cam shaft being rotatably mounted in an internal combustion engine cylinder head, an inner rotor fixedly mounted on the distal end portion of the cam shaft, an outer rotor mounted on the inner rotor so as to be rotatable within an angular range and constituting a rotation transmitting mechanism, a vane associated with the inner rotor in one of integration and assembled modes, and a lock pin assembled to the outer rotor, the outer rotor being made of an aluminum alloy material, the aluminum alloy material being supplemented with at least an element selected from Sb ranging from 0.05 to 0.20 weight %, Na ranging from. 0.001 to 0.01 weight %, Sr ranging from 0.001 to 0.05 weight %, and Ca ranging from 0.0005 to 0.01 weight %, one of the inner rotor and the vane being made of a material which is obtained by caking a rapidly solidified aluminum powder containing therein at least an Si element ranging from 16 to 18 weight % and an Fe element ranging from 2 to 6 weight %.

An eighth aspect of the present invention is to provide a variable valve timing mechanism according to the seventh aspect wherein the Si element has an average particle diameter of 3 $\mu$m or less.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Hereinafter, embodiments of the present invention will be described in detail with reference to the attached drawings.

Figure 1:
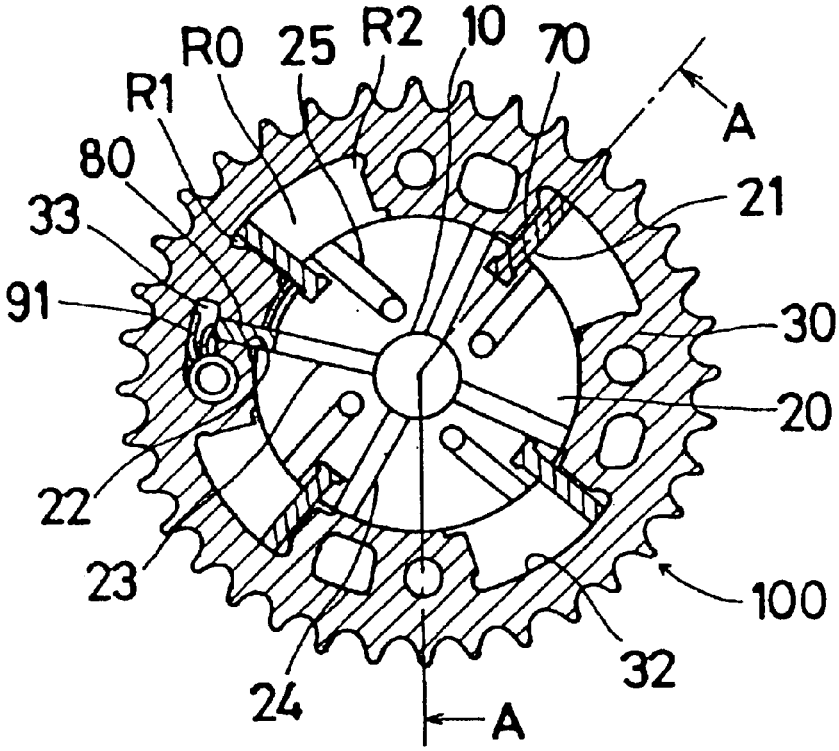
FIG. 1 is a cross-sectional view of a variable valve timing mechanism in accordance with the present invention.
Figure 2:
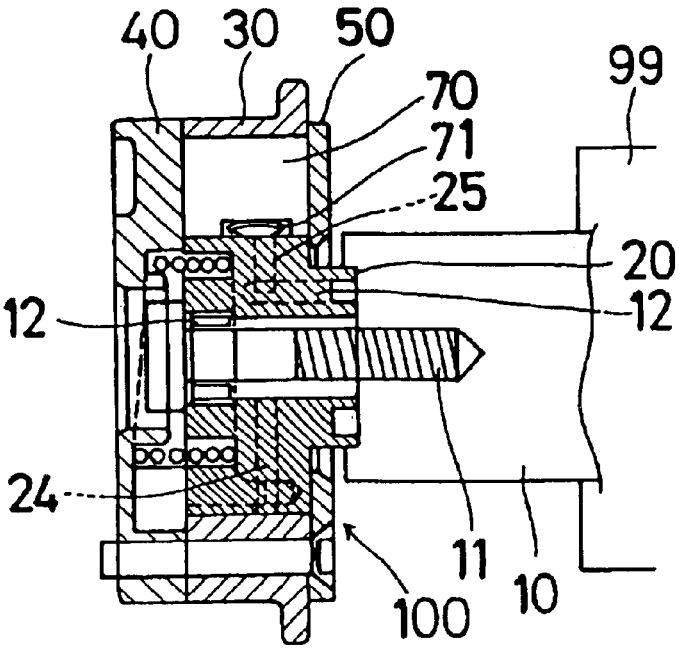
FIG. 2 is a cross sectional view taken along line 2—2 in FIG. 1.

First, referring to FIGS. 1 and 2, there is illustrated a variable valve timing mechanism 100. The variable valve timing mechanism 100 includes a camshaft 10, an inner rotor 20, an outer rotor 30, a front plate 40, a rear plate 50, four vanes 70, a lock pin 80, and other members or elements. The camshaft 10 has a distal end portion and is rotatably mounted in internal combustion engine cylinder head 99. The inner rotor 20 is fixedly mounted on the distal end portion of the camshaft 10. The outer rotor 30 is mounted on the inner rotor 20 so as to be rotatable within an angular range and cooperates with the front plate 40 and the rear plate 50 to constitute a rotation transmitting mechanism. The vanes 70 are assembled in the inner rotor 40. The lock pin 80 is assembled into the outer rotor 30.

The inner rotor 20, which rotates together with the camshaft 10, is provided therein with four equally pitched vane grooves 21 for receiving therein the four vanes 70, respectively. Each of the vane grooves 21 extends in the radial direction, which allows the corresponding vane 70 to move radially. The inner rotor 20 is provided therein with a receiving bore 22, a first passage 23, a second passage 24, and a third passage 25. The receiving bore 22 allows the lock pin 80 to fit therein to a degree whenever the camshaft 10 and the inner rotor 20 are brought into synchronization with the outer rotor 30 such that a relative rotation phase between the outer rotor 30 and each of the inner rotor 20 and the camshaft 10 attains a predetermined phase amount (i.e., a most delayed angle position) as depicted in FIG. 1. The first passage 23, which is connected to an advanced angle passage (not shown), serves for supplying therefrom and draining therein operating fluid to and from the receiving bore 22, respectively. The second passage 24 serves for establishing an operating fluid supply/drain between the advanced angle passage and an advanced angle fluid chamber R1 defined by each of the vanes 70. The third passage 25 serves for establishing an operating fluid supply/drain between a delayed angle passage 12 and a delayed angle fluid chamber R2 defined by each of the vanes 70.

Each of the vanes 70 is urged radially outwardly by a spring 71 which is placed in compressed fashion in the corresponding vane groove 21.

The outer rotor 30 is rotatably mounted on the inner rotor 20 such that an extremely. small gap is defined therebetween, and in which the operating fluid can flow. The outer rotor 30 is provided therein with four equally pitched concave portions 32 opposing to the inner rotor 20. Each of the vanes 70 is extended into the corresponding concave portions 32 to define therein an advancing chamber R1 and a delaying angle chamber R2. The outer rotor 30 is also provided therein with a retracting bore 33 which extends in the radial direction and which accommodates the lock pin 80 and a spring 91 urging the lock pin 80 toward the inner rotor 80.

In the variable valve timing mechanism which has the above-described structure, the outer rotor 30, which is in the form of a sprocket or gear, is formed by way of either casting or forging. The reason is that cutting a rapidly solidified material for obtaining the above-structured outer rotor 30 is very costly. By contrast, the inner rotor 20, which lacks teeth or sprockets, is formed by way of rapid solidification.

To produce the outer rotor 30, an aluminum alloy material is employed whose base material is an aluminum alloy casting which is identified by AC8C-JIS H5202 and which contains 2.0 to 4.0 weight % Cu, 8.5 to 10.5 weight % Si, 0.50 to 1.5 weight % Mg, not more than 0.5 weight % Zn, not more than 1.0 weight % Fe, not more than 0.5 weight % Mn, not more than 0.5 weight % Ni, not more than 0.20 weight % Ti, not more than 0.10 weight % Pb, not more than 0.10 weight % Sn, and not more than 0.10 weight % Cr, with the balance being Al. The base material is supplemented with at least an element so as to make the Si have an average particle diameter of 3 $\mu$m or less, which is selected from Sb ranging from 0.05 to 0.20 weight %, Na ranging from 0.001 to 0.01 weight %, Sr ranging from 0.001 to 0.05 weight %, and Ca ranging from 0.0005 to 0.01 weight %. Hereinafter, the above identified aluminum alloy casting is called a first sliding member.

If each of the above-listed elements becomes smaller than the lower limit of the above indicated range, the particle diameter of Si becomes larger. By contrast, if each of the above-listed elements becomes larger than the upper limit of the above indicated range, its strength or stiffness, extension property or extensibility, and toughness become lower, while the particle diameter of Si remains almost unchanged.

Each of the inner rotor 20, the vanes 70 and the lock pin 80, which are to be regarded as mating members of the outer rotor 30, is produced by cutting or casting an extrudate of rapidly solidified Al-Si-Fe system powder. Such an extrudate is hereinafter called a second sliding member. As a raw material of the Al-Si-Fe system powder, an aluminum powder is used which is rapidly solidified at a cooling rate of 102° C. to 104° C./second.

Figure 3:
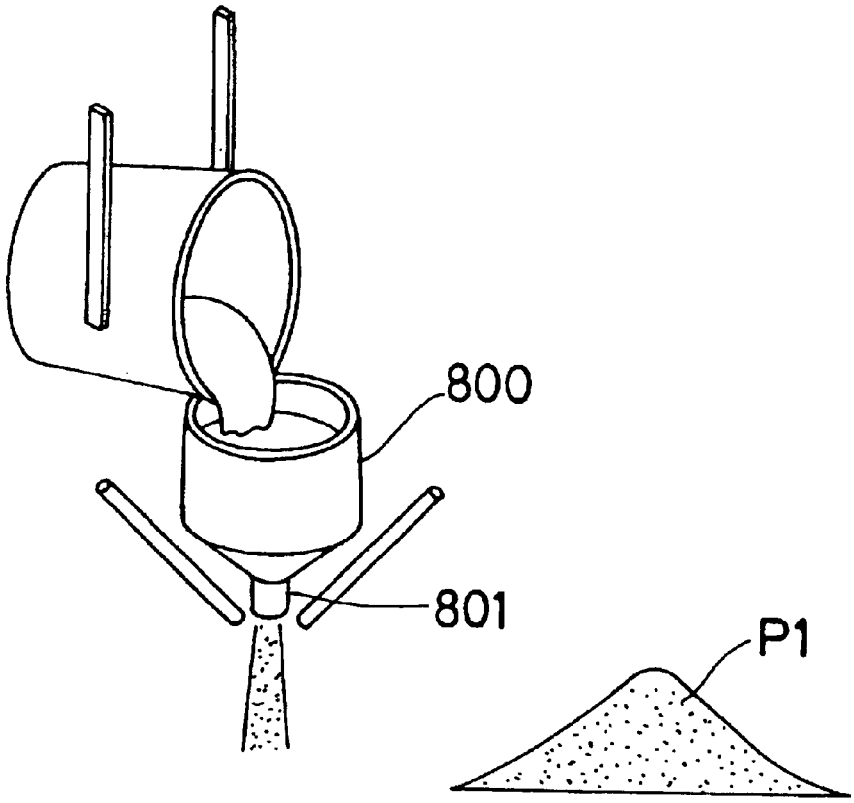
FIG. 3 shows how a rapidly solidified aluminum powder is produced.
Figure 4:
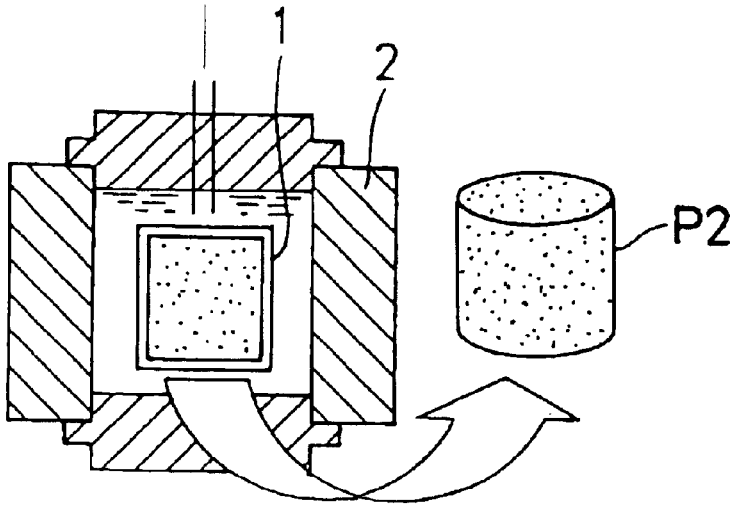
FIG. 4 shows how the rapidly solidified aluminum powder is pre-formed.

The above-mentioned aluminum powder is produced in such a manner that, as shown in FIG. 3, an aluminum liquid which has drained from an outlet port 801 of a vessel 800 is subjected to a jet of gas under a high pressure of 80–150 kgf /cm$^2$ for rapid solidification at a cooling rate of 100° C. to 10,000° C./second, thereby producing an aluminum powder P1. The aluminum liquid, before being put into the vessel 800, is in the form of an aluminum matrix in liquid phase, into which are added 16 to 18 weight % Si, 2 to 6 weight % Fe, 1 to 5 weight % Cu, 0.2 to 2 weight % mg, and 0.2 to 1 weight % Mn.

The aluminum powder P1 is packed into a membrane bag 1 which is placed in a cold hydrostatic process facility 2. Then the aluminum powder P1 is applied with a hydraulic pressure by way of the membrane bag 1, to produce a pre-formed or quasi-solid-state aluminum powder P2. Instead of the cold hydrostatic process, warm or hot hydrostatic process may be used.

Figure 5:
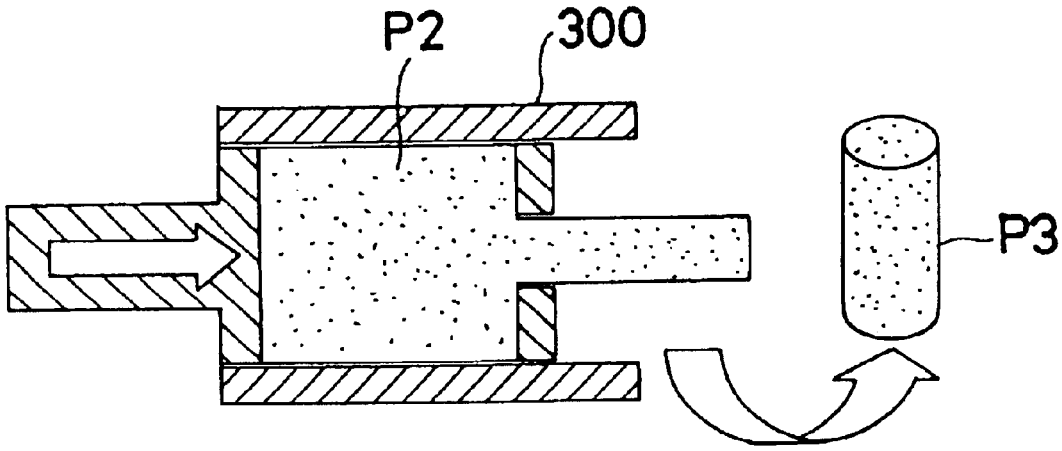
FIG. 5 shows how the pre-formed body is brought into hot extrusion.

As shown in FIG. 5, the above-described pre-formed aluminum powder P2 is, as a billet, put into a hot extrusion device 3 to produce an extrudate P3 at a hot extrusion temperature of 200° C. to 550° C.

Figure 6:
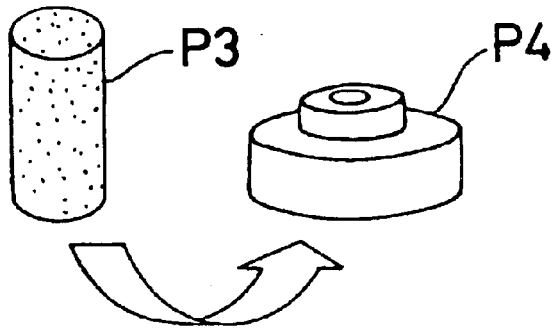
FIG. 6 shows how the hot extruded body is formed into a product.

Cutting, forging or mechanically processing the resulting extrudate P3 as shown in FIG. 6 results in formation or production of a device P4 such as the outer rotor 30, the lock pin 80 or the vane 70. In the aluminum matrix as the raw material of the device P4, the Si particles are spherical and have an average particle diameter of not more than 3 $\mu$m.

It is to be noted that in the raw material composition of the second sliding member the amount of Si is set to be 16 to 18 weight %, which makes it possible to increase the abrasion resistance of the second sliding member. If the amount of Si is less than 16 weight %, the abrasion resistance of the second sliding member becomes insufficient, resulting in abnormal wear such as mainly adhesive wear. On the other hand, if the amount of Si is more than 18 weight %, the possible damaged degree of the mating member (i.e. the first member) becomes larger.

The amount of Fe is set to be 2 to 6 weight %, which improves the second sliding member in seizure resistance and heat-proof strength. If the amount of Fe is less than 2 weight %, seizure may occur upon engagement between the first and second sliding members. On the other hand, if the amount of Fe is more than 6 weight %, the resulting separated-out needle crystals will increase the possible damaged degree of the mating member (i.e., the first member).

The amount of Cu is set to be 1 to 5 weight %, to improve the second sliding member in mechanical property. In a case where the amount of Cu is less than 1 weight %, the second sliding member becomes poor in mechanical property. On the other hand, if the amount of Cu is more than 5 weight %, the second sliding member becomes poor in extensibility.

The amount of Mg is set to be 0.2 to 2 weight %, to improve the second sliding member mechanical properties. In a case where the amount of Mg is less than 0.2 weight %, the second sliding member becomes poor in mechanical property. On the other hand, if the amount of Mg is more than 2 weight %, the second sliding member becomes poor in extensibility.

The amount of Mn is set to be 0.2 to 1 weight %, which results in prevention of re-crystalization and mechanical property improvement in the second sliding member. If the amount of Mn is less than 0.2 weight %, re-crystalization occurs to make the structure crude, resulting in seizure and subsequent lowering of the mechanical property. On the other hand, if the amount of Mn is more than 1 weight %, possible insoluble compounds separated out from the matrix causes the friction coefficient of the second sliding member to increase.

The average particle diameter of the Si is set to be not more than 3 $\mu$m, which improves the second sliding member in abrasion resistance and seizure resistance. In a case where the average particle diameter of Si is more than 3 $\mu$m, the friction coefficient of the second sliding member is increased, which results in seizure and abrasion in the second sliding member when the first and second sliding members are in engagement.

It is to be noted that so long as the amount of Si is 16 to 18 % weight and the amount of Fe is 2 to 6 weight %, even though the amount of each of other elements differs from the above indication, the abovedescribed excellent sliding characteristics of the second sliding member can be obtained.

Figure 7A:
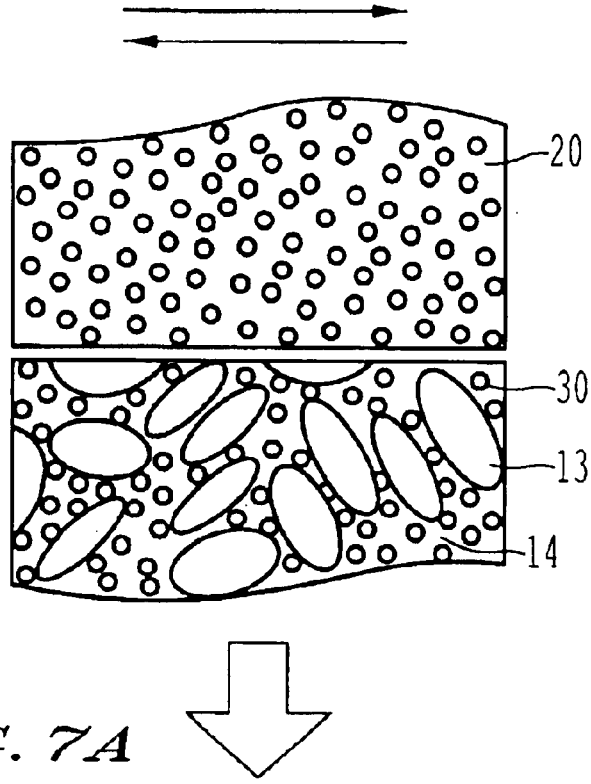
FIG. 7(*a*) and FIG. 7(*b*) show a pre-sliding engagement state and a post-sliding engagement state, respectively, in a sliding mechanism in accordance with the present invention.
Figure 7B:
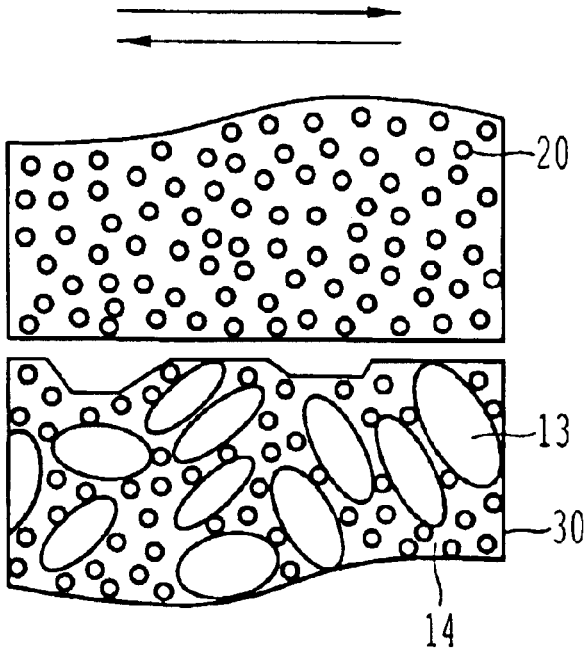

The following description explains, by means of experiments, why the above-described sliding characteristics can be obtained, with reference to FIGS. 7(*a*) and 7(*b*). In FIG. 7(*a*), there is illustrated the second sliding member 20 mounted on the first sliding member 30 before the former is brought into sliding engagement with the latter. By contrast, in FIG. 7(*b*), there is illustrated the second sliding member 20 mounted on the first sliding member 30 after reciprocal sliding engagement of the former with the latter.

Along an aluminum flux line of the second sliding member 20, there are dispersed numerous Si particles in a homogeneous fashion, while an aluminum flux line of the first sliding member 30 is made of portion 13 without Si particles and portion 14 in which Si particles are dispersed. The portion 13, which can be called a soft portion, is inferior to the portion 14 in mechanical strength.

When a comparison is made between the FIG. 7(*a*) illustration and the FIG. 7(*b*) illustration, at an initial stage of the above-mentioned reciprocal sliding engagement between the sliding members 30 and 20, the soft portions of the second sliding member 20 which are arranged along its surface are worn to form concave portions. A lubricating oil applied between the sliding members 30 and 20 enters into each of the resulting concave portions, which results in a forced oil film at an interface between the sliding members 30 and 20. Thus, the friction coefficient of each of the sliding members 30 and 20 is made smaller, the heat generation upon sliding engagement therebetween becomes lower, resulting in seizure.

In addition, even though some of the Si particles are turned into wear particles which appear along the surface of the second sliding member 20, each of the resulting Si wear particles is of spherical shape and is of a diameter less than the oil film thickness, which makes it possible to maintain smooth sliding engagement between the sliding members 10 and 20.

In brief, the excellent sliding performance seems to be based on the following: Making the average particle diameter of Si not more than 3 $\mu$m, preferably 1 to 2 $\mu$m, results in the possible Si wear particle diameter being less than the oil film thickness of 3 $\mu$m, which makes it possible to maintain smooth sliding engagement between the sliding members 30 and 20. The soft portions along the aluminum flux line of the first sliding member 30 are worn prior to Si particle wear, which causes each of the resulting concave portions to accommodate oil, ensuring sufficient lubrication between the sliding members 30 and 20, thereby preventing seizure.

Figure 8A:
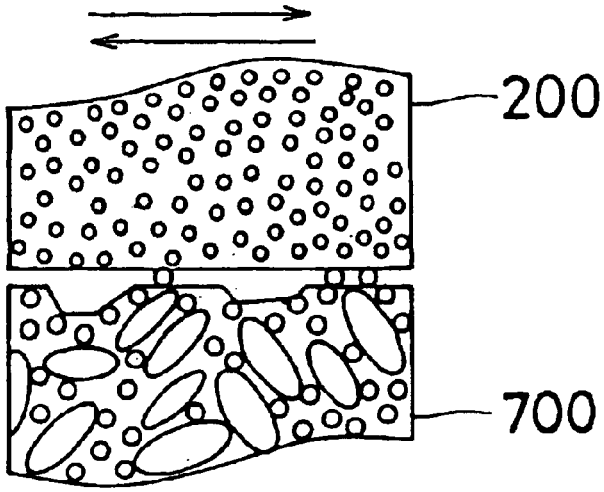
FIG. 8(A) shows a post-sliding engagement state in a comparative example 1.
Figure 8B:
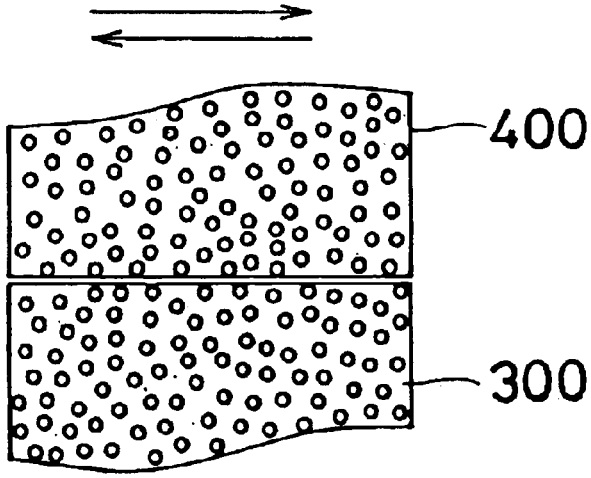
FIG. 8(B) shows a post-sliding engagement state in a comparative example 2.
Figure 8C:
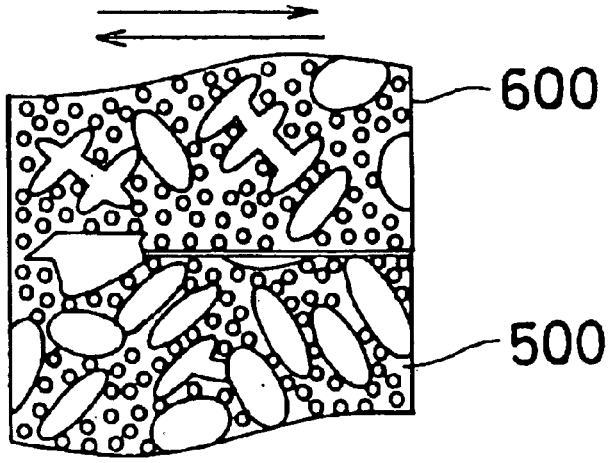
FIG. 8(C) shows a post-sliding engagement state in a comparative example 3.

Referring to FIG. 8(*a*), there is depicted a comparative example 1, wherein a first sliding member 700 and a second sliding member 200 are brought into reciprocal sliding engagement. The second sliding member 200 of this comparative example 1 is similar to the second sliding member 20 of the above-mentioned embodiment, while the first sliding member 700 of this comparative example 1 is similar to the first sliding member 10 of the above-mentioned embodiment, except that in the former the average particle diameter of Si is set to be more than 3 $\mu$m. Thus, when the Si particles turn into wear particles, the average particle diameter of each of the Si wear particles is not less than the oil film thickness which is 3 $\mu$m, which causes the second sliding member 200 to engage with these Si wear particles, resulting in excess friction and seizure between the sliding members 700 and 200.

Referring to FIG. 8(*b*), there is depicted a comparative example 2, wherein a first sliding member 300 and a second sliding member 400 are brought into reciprocal sliding engagement. Each of the first sliding member 300 and the second sliding member 400 are identical with the second sliding member 20 of the above mentioned embodiment. In such a structure, no oil reserving portions are formed between the first sliding member 300 and the second sliding member 400, which makes it difficult to form an oil film therebetween. Thus, when a reciprocal sliding movement occurs between the sliding members 300 and 400 such that a high load application onto either sliding member results, a direct or solid-to-solid contact may occur between the sliding members 300 and 400, which increases the friction coefficient, resulting in possible occurrence of seizure.

Referring to FIG. 8(*c*), there is depicted a comparative example 3 wherein a first sliding member 500 and a second sliding member 600 are brought into reciprocal sliding engagement. Each of the first sliding member 500 and the second sliding member 600 is identical with the first sliding member 10 of the above-mentioned embodiment.

In such a structure, sometimes a soft portion may be brought into adhesion locally, and at the resulting portion adhesive wear may progress. In a case of employment of an aluminum casting member or expanded aluminum member as each of the first and second members, a similar problem occurs.

Figure 9:
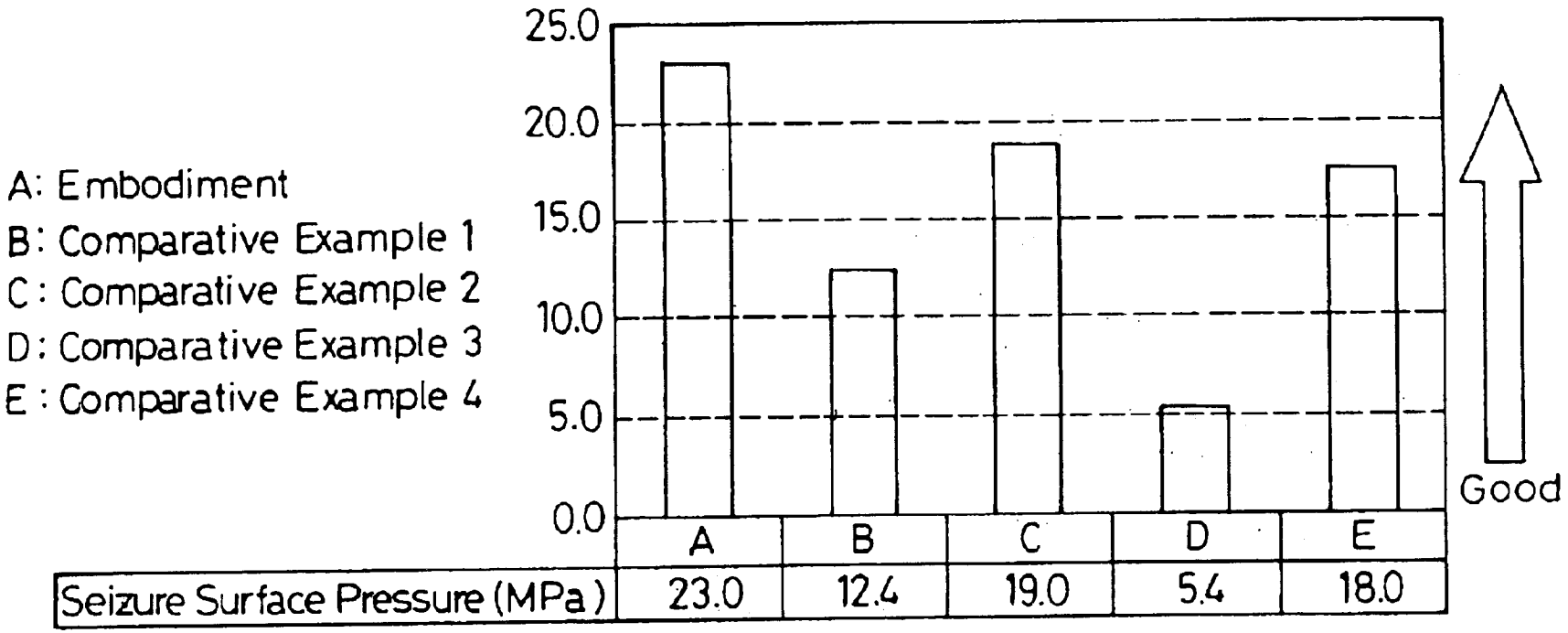
FIG. 9 is a graph representing seizure resistances of the present invention, the conventional examples 1–3, and a conventional example 4.

Referring to FIG. 9, there is illustrated a graph of test results which were conducted for the determination or measurement of seizure resistance with respect to the present embodiment, the comparative example 1, the comparative example 2, the comparative example 3, and a comparative example 4 in which a pair of sintered Fe material sliding members are brought into reciprocal sliding engagement.

Test Conditions

Sliding mode: Ring-on-disk type friction wear test machine.

Peripheral velocity: 0.6 m/sec.

Load: Increasing until seizure occurs or the load attains its maximum value of 25 Mpa, such that every 3 minutes the load is increased in increments of 0.5 Mpa.

Lubrication oil: 5W-30 SJ-class engine oil.

Oil amount: 200 ml.

Oil temperature: no control.

FIG. 9 reveals that the present embodiment is excellent in seizure resistance when compared to the comparative examples 1 through 4.

Figure 10:
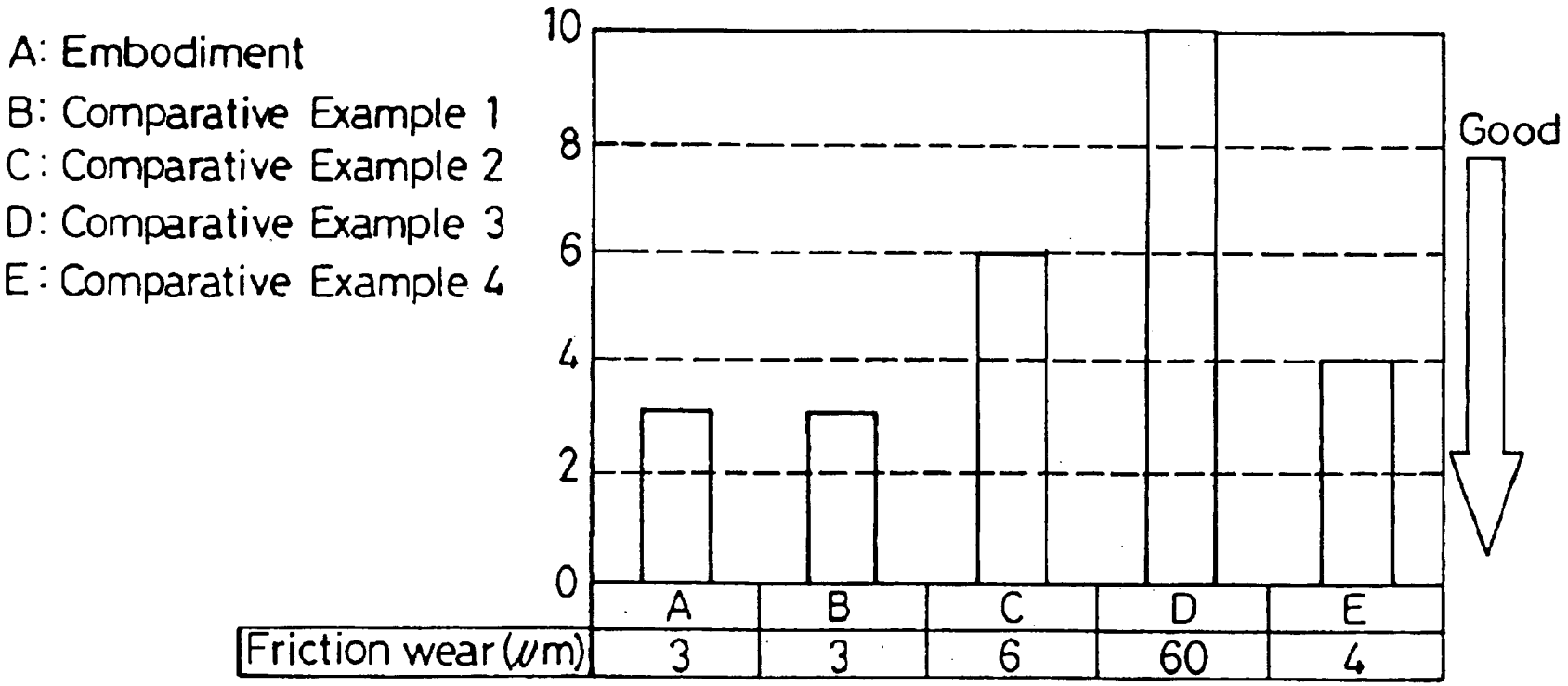
FIG. 10 is a graph representing abrasion resistances of the present invention and the conventional examples 1–4.

Referring to FIG. 10, there is illustrated another graph of test results which were conducted for the determination or measurement of abrasion resistance with respect to the present embodiment, and the comparative examples 1 through 4.

Test Conditions

Sliding mode: Ring-on-disk type friction wear test machine.

Peripheral velocity: 0.6 m/sec.

Load: 2 Mpa (constant or fixed).

Test time duration: 5 hours.

Sliding distance 10800 m.

Lubrication oil: 5W-30 SJ-class engine oil.

Oil amount: 200 ml.

Oil temperature: no control.

FIG. 10 shows that the present embodiment is excellent in abrasion resistance when compared to the comparative examples 1 through 4.

Figure 11:
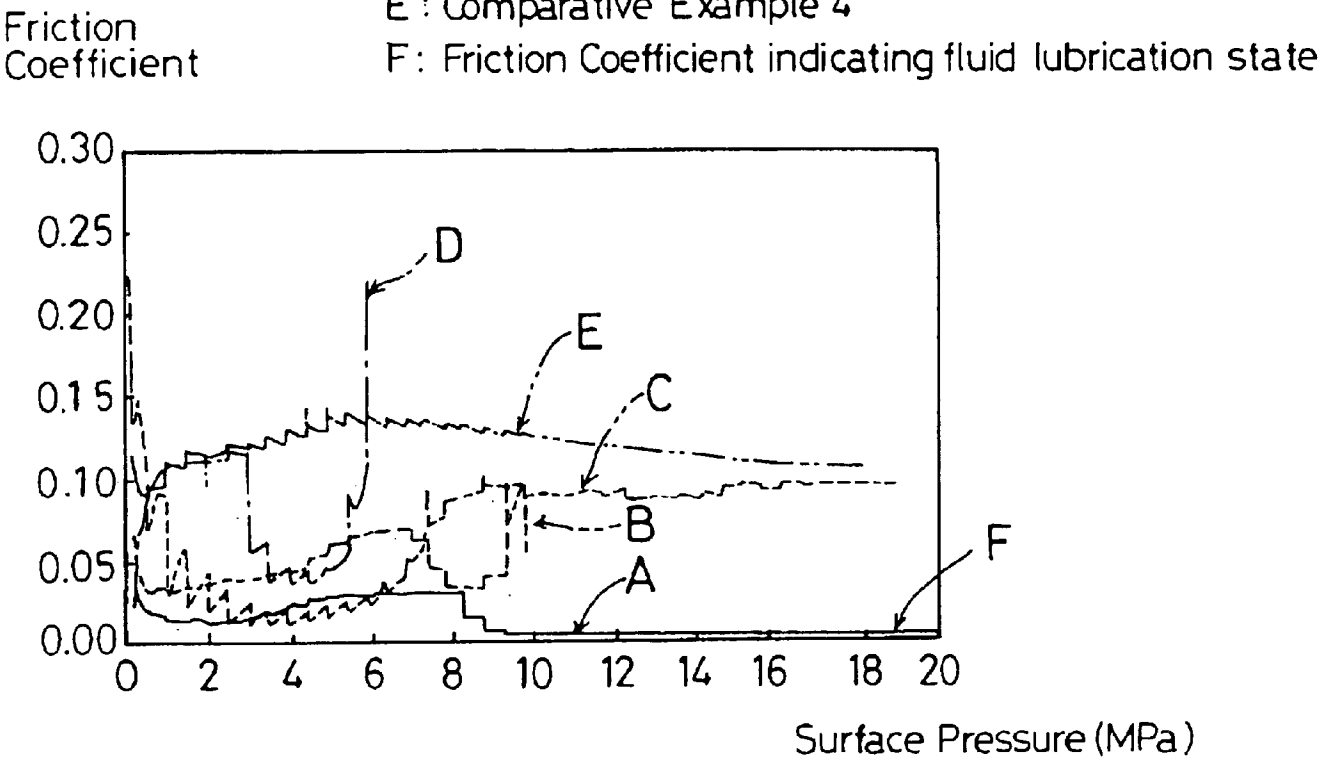
FIG. 11 is a graph representing a relationship between surface pressure and friction coefficient for each of the present invention and the conventional examples 1–4.

Referring to FIG. 11, there is shown a graph representing a relationship between surface pressure and friction coefficient in each of the present embodiment and the comparative examples 1 through 4. Each of the relations was a test result for each of the present embodiment and the comparative examples 1 through 4. These tests were conducted according to the following conditions.

Test Conditions

Sliding mode: Ring-on-disk type friction wear test machine.

Peripheral velocity 0.6 m/sec.

Load: Increasing until the seizure occurs or the load attains its maximum value of 25 Mpa, such that every 3 minutes the load is increased in increments of 0.5 Mpa.

Lubrication oil: 5W-30 SJ-class engine oil.

Oil amount: 200 ml.

Oil temperature: no control.

The graph shown in FIG. 11 shows that the present embodiment is excellent in friction coefficient. In addition, the present provides a very small friction coefficient of 0.0003 when the surface pressure is 10 Mpa or above, and the sliding interface between the sliding members is in a fluid lubrication state or fully oil film formed state.

The above-indicated test results show that the present embodiment is superior to the comparative examples 1 through 4 in seizure resistance, abrasion resistance and friction coefficient, and therefore the conventional raw materials, such as a Fe sintered material or typical aluminum material, fails to meet fully the product specification.

Table listed below compares mechanical characteristics with the raw material of each of the comparative examples.

| Material Item ItemItem | Rapidly Solidified Al (2nd sliding member of embodiment) | Sintered Fe (Comparative Example 4) | Typical Al Casting (1st sliding member of Comparative Example 1) |
|---|---|---|---|
| Tensile Strength (Mpa) | 451 | 350 | 544 |
| 02% Yield Strength | 363 | 270 | 497 |
| Stretch (%) | 1.5 | 12 | 9 |
| Fatigue Strength (Mpa) | 195 | 140 | 206 |
| Hardness (HV) | 165 | 120 | 135 |
| Density (g/cm$^{3)}$ | 2.8 | 6.85 | 2.8 |

It is apparent from this Table that the present embodiment can provide a raw material from which a stronger and more than 50% lighter variable valve timing mechanism can be obtained.

It is to be noted that the above-described concept can be applied to other devices, particularly vehicle mounted devices, such as an engine oil pump, a transmission oil pump, a power steering oil pump and a set of a piston and cylinder.

The invention has thus been shown and description with reference to specific embodiments, however, it should be understood that the invention is in no way limited to the details of the illustrated structures but changes and modifications may be made without departing from the scope of the appended claims.

What is claimed is:

1. A sliding mechanism comprising:

a first sliding member comprising an aluminum alloy material, the aluminum alloy material being supplemented with at least one element selected from the group consisting of Sb ranging from 0.05 to 0.20 weight %, Na ranging from 0.001 to 0.01 weight %, Sr ranging from 0.001 to 0.05 weight %, and Ca ranging from 0.0005 to 0.01 weight %; and a second sliding member arranged so as to be brought into sliding engagement with the first sliding member, the second sliding member comprising a material which is obtained by caking a rapidly solidified aluminum powder containing therein at least an Si element and an Fe element.

2. A sliding mechanism as set forth in claim 1, wherein the Si element has an average particle diameter of 3 $\mu$m or less.

3. A sliding mechanism comprising:

a first sliding member comprising an aluminum alloy material, the aluminum alloy material being supplemented with at least one element selected from the group consisting of Sb ranging from 0.05 to 0.20 weight %, Na ranging from 0.001 to 0.01 weight %, Sr ranging from 0.001 to 0.05 weight %, and Ca ranging from 0.0005 to 0.01 weight %; and a second sliding member arranged so as to be brought into sliding engagement with the first sliding member, the second sliding member comprising a material which is obtained by caking a rapidly solidified aluminum powder containing therein at least an Si element ranging from 16 to 18 weight % and an Fe element ranging from 2 to 6 weight %.

4. A sliding mechanism as set forth in claim 3, wherein the Si element has an average particle diameter of 3 $\mu$m or less.

5. A variable valve timing mechanism for controlling one of intake and exhaust valves comprising:

a cam shaft having a distal end portion, the cam shaft being rotatably mounted in an internal combustion engine cylinder head;

an inner rotor fixedly mounted on the distal end portion of the cam shaft;

an outer rotor mounted on the inner rotor so as to be rotatable within an angular range and constituting a rotation transmitting mechanism;

a vane associated with the inner rotor; and a lock pin assembled to the outer rotor, the outer rotor comprising an aluminum alloy material, the aluminum alloy material being supplemented with at least one element selected from the group consisting of Sb ranging from 0.05 to 0.20 weight %, Na ranging from 0.001 to 0.01 weight %, Sr ranging from 0.001 to 0.05 weight %, and Ca ranging from 0.0005 to 0.01 weight %, one of the inner rotor and the vane comprising a material which is obtained by caking a rapidly solidified aluminum powder containing therein at least an Si element and an Fe element.

6. A variable valve timing mechanism as set forth in claim 5, wherein the Si element has an average particle diameter of 3 $\mu$m or less.

7. A variable valve timing mechanism for controlling one of intake and exhaust valves, comprising:

a cam shaft having a distal end portion, the cam shaft being rotatably mounted in an internal combustion engine cylinder head;

an inner rotor fixedly mounted on the distal end portion of the cam shaft;

an outer rotor mounted on the inner rotor so as to be rotatable within an angular range and constituting a rotation transmitting mechanism;

a vane associated with the inner rotor; and a lock pin assembled to the outer rotor, the outer rotor comprising an aluminum alloy material, the aluminum alloy material being supplemented with at least one element selected from the group consisting of Sb ranging from 0.05 to 0.20 weight %, Na ranging from 0.001 to 0.01 weight %, Sr ranging from 0.001 to 0.05 weight %, and Ca ranging from 0.0005 to 0.01 weight %, one of the inner rotor and the vane comprising a material which is obtained by caking a rapidly solidified aluminum powder containing therein at least an Si element ranging from 16 to 18 weight % and an Fe element ranging from 2 to 6 weight %.

8. A variable valve timing mechanism as set forth in claim 7, wherein the Si element has an average particle diameter of 3 $\mu$m or less.

* * * * *